United States Patent [19]

Bajulaz

[11] 4,391,200

[45] Jul. 5, 1983

[54] MEDIUM DISTANCE TRANSPORT DEVICE

[76] Inventor: Roger Bajulaz, Chemin William Barbey 22, 1292 Chambesy, Geneva, Switzerland

[21] Appl. No.: 220,069

[22] PCT Filed: Apr. 25, 1980

[86] PCT No.: PCT/CH80/00049

§ 371 Date: Dec. 16, 1980

§ 102(e) Date: Dec. 16, 1980

[87] PCT Pub. No.: WO80/02403

PCT Pub. Date: Nov. 13, 1980

[30] Foreign Application Priority Data

May 4, 1979 [CH] Switzerland ..... 4200/79

[51] Int. Cl.[3] ..... B61K 1/00

[52] U.S. Cl. ..... 104/20; 104/25; 105/329 R; 105/341; 105/343

[58] Field of Search ..... 198/321, 334; 104/20, 104/25, 288, 18, 28, 30; 105/329 R, 329 S, 330, 341, 343

[56] References Cited

U.S. PATENT DOCUMENTS

| | | | |
|---|---|---|---|
| 343,229 | 6/1886 | Comer | 105/343 |
| 3,136,266 | 6/1964 | Seidman | 104/25 |
| 3,811,385 | 5/1974 | Johnson et al. | 104/25 |
| 3,871,303 | 3/1975 | Woodling | 104/20 |
| 4,071,135 | 1/1978 | Ishikawa et al. | 198/321 |
| 4,149,471 | 4/1979 | Tauzin et al. | 105/343 |

*Primary Examiner*—Joseph E. Valenza

*Attorney, Agent, or Firm*—Young & Thompson

[57] ABSTRACT

The device comprises cabins allowing a front or side access, each cabin having a first part and a second part. The first part of the cabin comprises a frame (6), rolling along a rolling track (1,2), carrying a fixed floor (11) surrounded by a fixed protection wall (12). The second part of the cabin comprises a rectangular grooved plate (13). In the loading and unloading areas the plates (13) of adjacent cabins are in contact and form a continuous carpet. A rotary moving door (23) surrounds the cabin when the latter moves individually outside the loading and unloading areas.

9 Claims, 7 Drawing Figures

FIG. 7
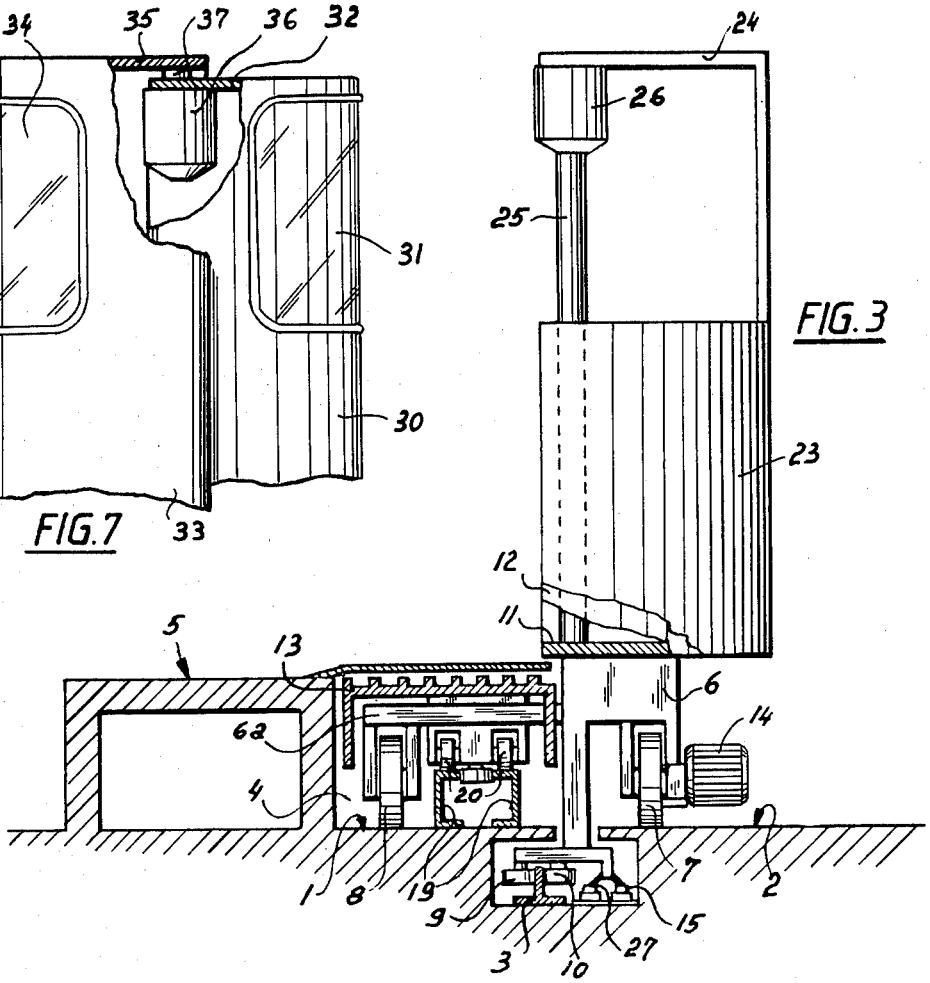
FIG. 3
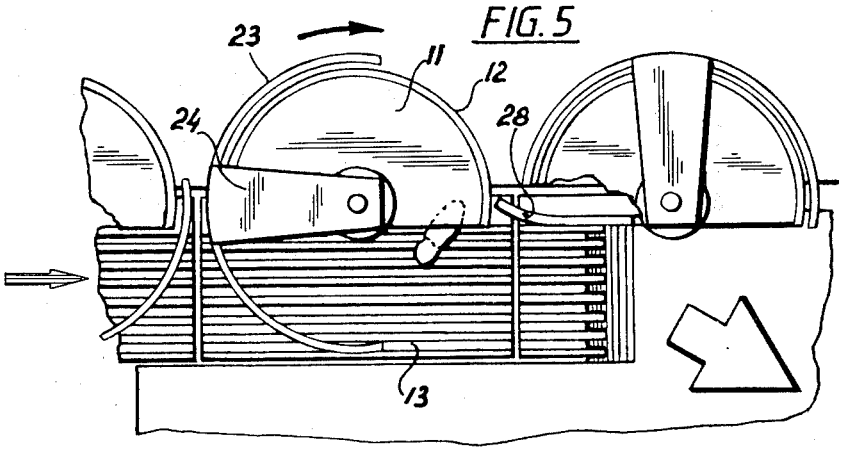
FIG. 5

MEDIUM DISTANCE TRANSPORT DEVICE

TECHNICAL FIELD

The present invention has for its object a continuous transport device, for persons or merchandise, along medium distances, that is to say of the order of 50 to 500 meters.

PRIOR ART

For such hectometric transport there are now three existing main solutions which are:

A. The rolling footways which have the main disadvantage of a low continuous velocity of about 60 cm/s. Furthermore they are expensive and cumbersome.

B. The telecabin the main drawback of which is the entrance into them or their loading which is made laterally, that is perpendicularly to the displacement of the cabins and this is dangerous for slow, loaded or handicapped persons.

C. The rolling telescopic carpets formed of interfingering combs which can thus be driven at different speeds in the loading areas than on the rest of the pathway. The time for the course can thus be reduced but the necessary mechanism is too, cumbersome and expensive.

D. The variable speed loading and unloading systems enabling the passengers to walk in the vehicles without relative speed. The drawbacks of these integrators are their cost and their very large size.

SUMMARY DESCRIPTION OF THE INVENTION

The present invention has for its object a transport device for persons tending to avoid these drawbacks, comprising a continuous rollway, closed on itself, and several cabins displaced along this rollway. This device distinguishes itself by the fact that each cabin comprises a carrier frame mounted on wheels following the rollway, by the fact that a first part of the cabin is formed of a normal floor, a wall and at least one door, the hinges of which are fast with this part of the cabin whereas the other part of the floor of the cabin is formed by a grooved rectangular plate of the rolling carpet type, the greatest part of it is disengaged from the first part it thus to pass under entrance and outlet combs and to disappear under the fixed floor located in the loading and unloading areas. A special door pivoted at the top of the first part of the cabin is guided at its lower portion by its wall and pivots of 360° around its axis in steps of 90° each and always in the same direction. This door closes partially in front of the passengers as soon as the grooved plate comes out of its comb. After continuation of the circular movement, the passengers are confined in an approximately circular cabin. The door has made half a rotation of 180°. Upon the arrival the door opens behind the passengers turning always in the same direction and finishes opening before the passage of the grooved plate under its comb. The door has made a complete cycle of 360° and is completely hidden behind the wall of the rear part of the cabin.

NOMENCLATURE OF THE FIGURES

The attached drawing shows schematically and by way of example one embodiment of the hectometric transport device according to the invention.

FIG. 3 is a cross section, perpendicular to the rollway, of a cabin located in a loading or unloading area.

FIG. 5 is a plan view, on a larger scale, showing the positioning of the plate of a cabin with respect to the loading platform.

FIG. 7 shows partially a modification of a cabin.

DESCRIPTION OF AN EMBODIMENT OF THE INVENTION

Figure 1:
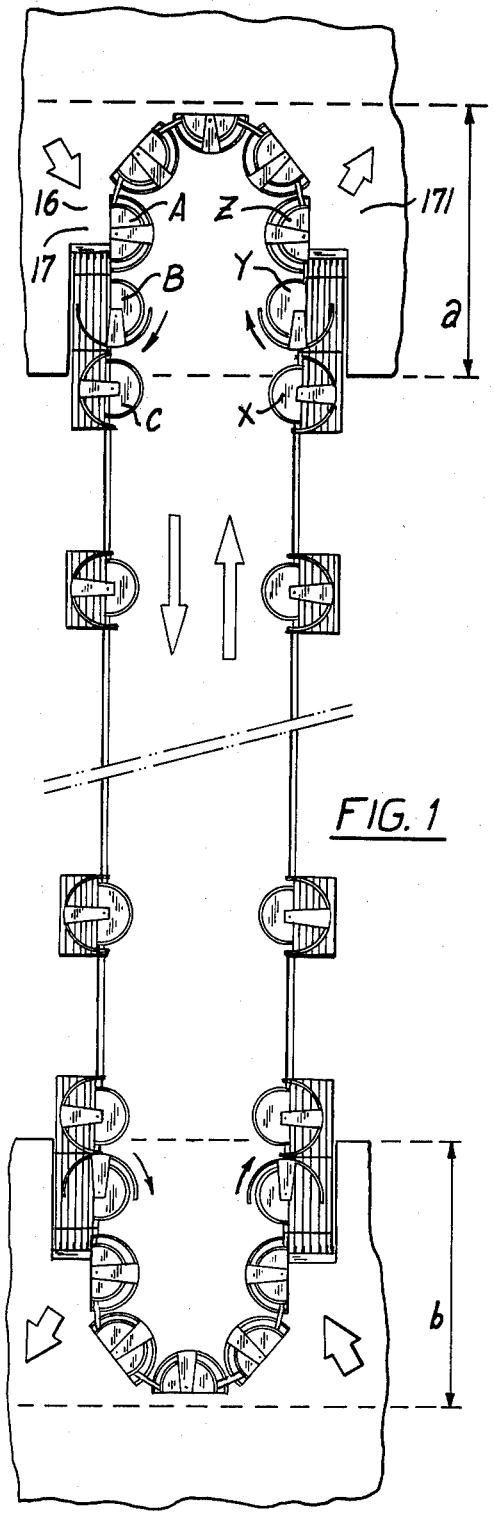
FIG. 1 is a schematic plan view of the transport device.
Figure 2:
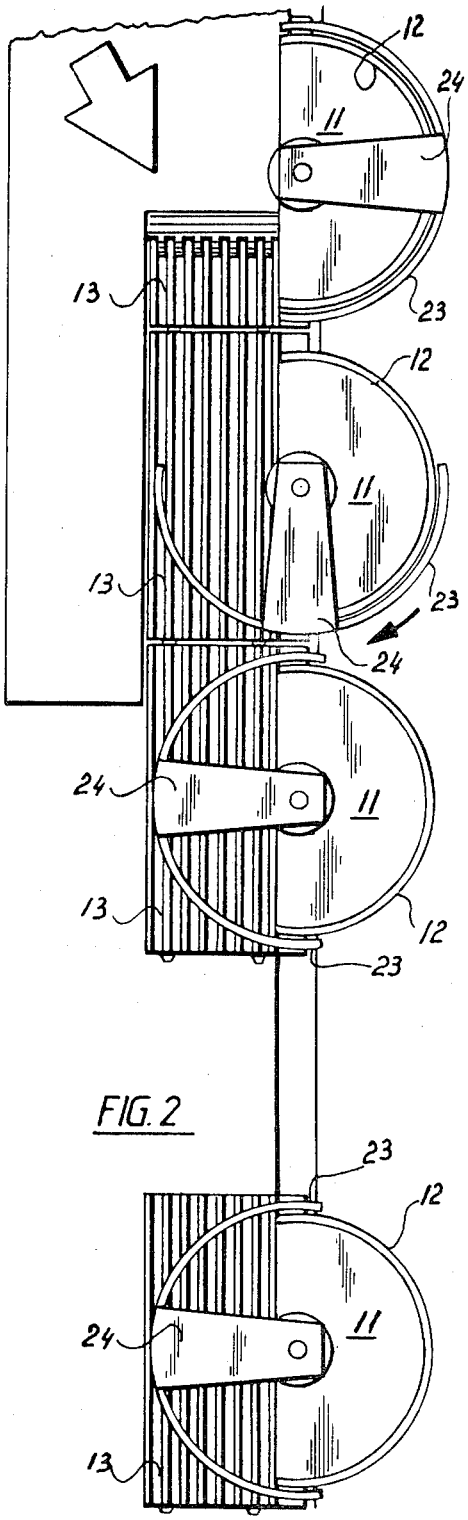
FIG. 2 is a partial plan view, on a larger scale, of the transport device.
Figure 4:
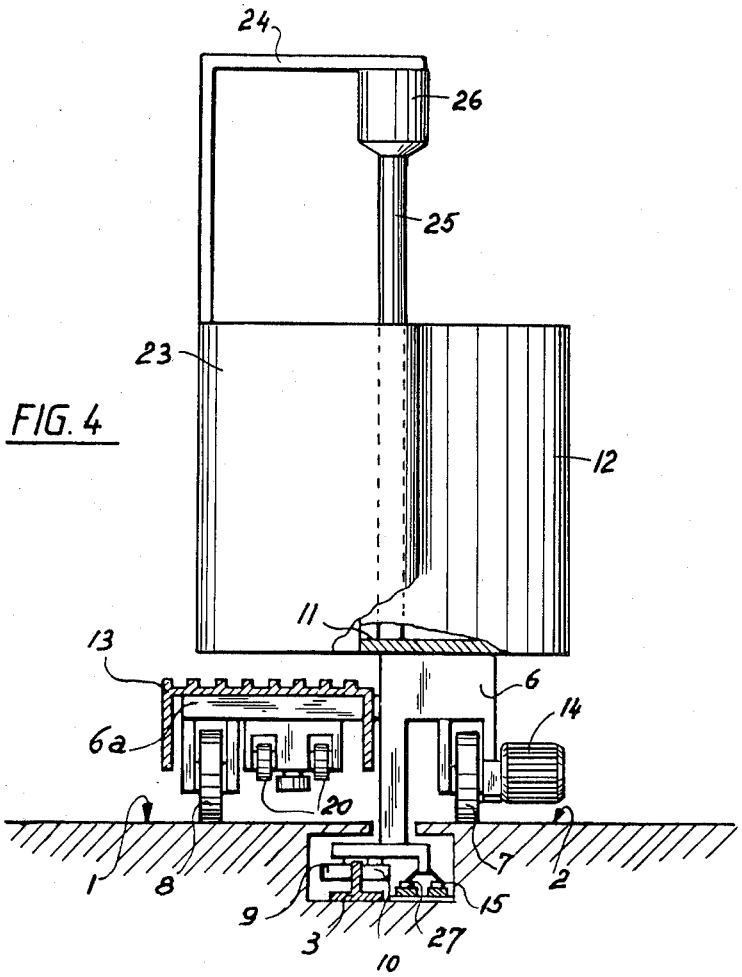
FIG. 4 is a view similar to FIG. 3, the cabin being located outside of a loading or unloading area.

The transport device shown comprises a rolling track formed of two planar rolling surfaces 1, 2 and of a guiding rail 3 located in a T-shaped groove separating the rolling surfaces 1 and 2. This rolling track is continuous and closed on itself. Generally it will take the shape of two rectilinear portions connected at their ends by arcs of circles, however, it is evident that this rolling track could follow any path along which passengers have to be transported.

This path may be sinuous and even change elevation. It is also evident that the "one-way" track does not need to follow the "return" track but that a given circuit can be followed.

The rolling surfaces 1, 2 are placed in a pit or trench 4 so that, in working, the floor of the cabins will be approximately located at ground level 5.

Each cabin comprises a frame 6 provided with wheels 7, 8 rolling respectively on the rolling surfaces 1, 2 and guiding rollers 9, 10 laterally cooperating with the sides of the guiding rail 3 to guide the cabin along the rolling track.

A part, for example one half, of the floor of each cabin is formed by a semi-circular sheet 11, rigidly fastened to the frame 6. This portion of the floor 11 is surrounded by a gird or wall 12 also rigidly fixed to the frame 6.

The other part of the floor of each cabin is formed by a plate 13 normally resting under its own weight on cross members 6*a* of the frame 6 but being able to be freely displaced along at least two orthogonal directions, laterally and vertically, with respect to the frame 6. Furthermore, these plates 13 have, seen from above, a rectangular shape the length of which is slightly greater than the diameter of the fixed floor 11 of a cabin. These plates 13 extend thus forwardly and rearwardly, in the direction of the displacement, beyond the cabin to which they belong. In this way when two neighboring cabins are joined on a rectilinear portion of the rolling track, the plates 13 of these cabins are in frontal abutment and form a continuous floor.

Normally, when the cabins are displaced individually, between the loading and unloading stations, they are separated the ones from the others and the plate 13 is in its lower position resting on the cross members 6*a*. Each cabin is driven in its displacements by a motor 14 which may be electric and is fed by brushes sliding on conductive rails 15 located in the T-shaped groove housing the rail 3. The feeding voltage of the conductive rails 15 may vary according to the portion of the rolling track considered so that the cabins move at variable speeds along the rolling track. Particularly the cabins are driven at a slow speed, of the order of 40 cm/s in the loading and unloading areas, where the cabins are joined, and at a high speed between these stations of the order of 2.5 m/s. Thanks to the slow speed one will see that it is very easy to step on the transport device and to step out of it also, whereas the duration of the course is greatly reduced by the high speed displacement between the stations.

Figure 6:
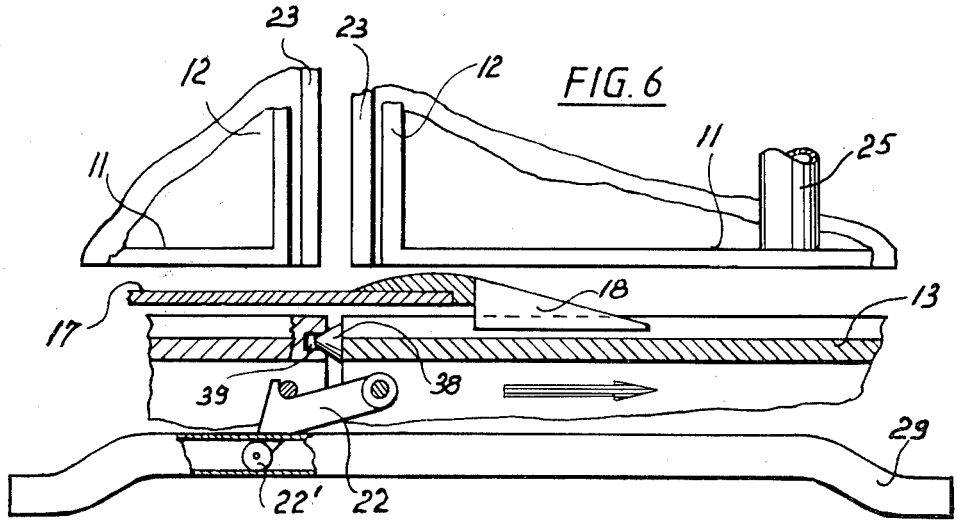
FIG. 6 is a longitudinal cross section of a plate of a cabin located in the immediate vicinity of the loading platform.

Each loading or unloading area comprises a loading platform 16 provided with a rectilinear portion 17 extending parallel to the direction of displacement of the cabins. The plate 13 of the cabin located under this portion of the loading platform. Portion 17 terminates in a comb 18, as in the rolling carpets, and in this area rises 19 are located which act on rollers 20 carried by arms fast with the plate 13 in order to lift this plate and to place it in its raised position (FIGS. 3 and 6) for which it constitutes an extension of the portion 17 of the loading platform.

In the embodiment shown the cabins are driven at a reduced speed in the end portions a, b which form the loading and unloading areas. In these areas the cabins are joined and on the rectilinear portions of these end portions the plates 13 are in frontal abutment and are connected the ones to the others by means of a hook 22 bearing a roller 22', which is automatically set in place by means of a cam, constituted by a fixed rail 29, located along the rolling track in the portion of it where the hook has to be operative, that is when the plates 13 have to be coupled.

The frontal edge of each plate 13 has at least one conical positioning housing 39 receiving, when the plates 13 are joined in the loading and unloading areas, bosses 38 having a corresponding shape. The plates are thus, in said areas, coupled and positioned, so that they form a rigid floor. Thus, despite the load modification which the plates may undergo when the passengers step in or out, they cannot undergo any relative movement between them and constitute a continuous loading or unloading carpet.

As a cabin A reaches the beginning of said rectilinear portion, it is aligned with the preceeding cabins B and C and the plates 13 of these three cabins are joined and constitute a continuous rolling carpet forming an extension of the end 17 of the loading platform. The persons may thus enter in front, in the direction of the movement, onto this continuous carpet without any difficulty. It is the same for the unloading where the cabins X, Y, Z are joined, their plates 13 being hooked the one to the other and forming an extension to the rectilinear portion 17 of the loading wharf.

In the middle position between end portions a, b of the rolling track the cabins are accelerated to reach their highest speed, and they separate thus the ones from the others, the hook 22 having been liberated. For this course at high speed the plates 13 are in lower position resting on the cross members 6*a* of the cabin.

It is evident that having stepped in frontally, as on a rolling carpet, the user can enter laterally onto the fixed floor 11 without any risk since there is so relative displacement in the direction of displacement, between this fixed floor 11 of the cabin and the movable plate 13.

In order to avoid that a passenger could stand between two plates 13 when they separate, each cabin is provided with a movable security barrier constituted by a semi-cylindrical wall 23 carried by an arm 24 pivoted on a central post 25 of the cabin. In a variant the movable wall forming the door of the cabin could be mounted, not on a central post, but on the deck of the cabin which would be fixed with respect to the floor 11 and the wall 12. An electric motor, which can be fed by the conductive rails 27 located in the T-shaped groove housing the guiding rail 3, enables pivoting this movable cylindrical wall around the central post 25. The supply of the motor 26 is such that when the cabin travels from position Z to position A, the movable wall is hidden behind the first wall 12, thus the cabin is open.

When the cabin has reached the position B, the movable wall has made one fourth of a turn and closes the front of the cabin, and thus closes the carpet formed by plates 13 in the forward direction. A user can no more from this moment on enter the preceding cabin. When the cabin reaches the position C, the movable wall has made half a revolution and completely closes the cabin; from this instant the cabin can be accelerated and leaves the following cabin.

The cabin remains closed up to position X of an unloading station. At Y, the movement wall as made $\frac{1}{4}$ of a revolution, always in the same direction and the passengers of the cabin can exit using the plate 13 of the preceeding cabin which is joined, before reaching the unloading wharf 17. When the cabin reaches the position Z, the movable wall is completely hidden behind the first fixed wall 12, and the cabin is completely open.

It is to be noted that in the loading and unloading areas the loading or unloading platform 17, 17' covers completely the plate 13 of each cabin and extends a small distance under the fixed floor of the cabin. This enhances the safety of the transport system.

It is further to be noted that during the high speed course the plates 13 are fast with the frame and thus with the fixed floor 11 of the cabins so that no relative movement between these elements is possible. On the contrary in the loading and unloading areas the plates 13, fast with the plates of the neighboring cabins, are positioned vertically and laterally with respect to the loading wharf, independently from the first part of the corresponding cabins. The positioning of the loading carpet formed of the joined plates with respect to the loading wharf is therefore independent from the charge and/or the position of the first part having a fixed floor of the cabins with respect to the rolling track.

The main advantages of this transport device are the following:

a. A frontal step in on the rolling carpet at a slow speed (40 cm/s).
b. A high hour rate, 5 to 6000 persons per hour for four-person cabins thanks to the high speed between the stations (2.5 m/s).
c. The simplicity of the mechanism which is not cumbersome and not expensive. In fact, on the high speed course the cabins are spaced apart by 8 to 10 m. The high cost elements, formed by the cabins, are thus limited in number and one obtains a reduction of the installation costs per linear course meter.
d. The total security of the passengers who may enter either in the direction of displacement or perpendicularly to it in each cabin.

e. The possibility to follow sinuous paths having a radius of curvature of about 3 to 5 m. as well as to change elevation.

In variants one can arrange that the grooved plate of each cabin is mounted rigidly on the frame of this cabin.

To increase the security in the loading and unloading areas a cam 28 can be provided to push out of the zone located under the fixed floor the foot of a passenger. Furthermore, under the fixed floor, parallel to its free edge one can provide for a sliding flap, of variable height, which closes simultaneously the void located between this fixed floor and the plate 13, that is between this fixed floor and the loading platform 17.

The cabin shown in FIG. 7 has a fixed wall 30, fast with the frame of the cabin, of a semi-cylindrical shape comprising a window 31 and a ceiling 32. The door of the cabin is here constituted by a movable wall 33 also semi-cylindrical in shape guided in its lower portion around the fixed wall 30. This movable wall has a window 34 and a ceiling 35. An electric motor 36, fixed to the ceiling 32 drives through its shaft 37, fixed to the ceiling 35, the door in its angular displacements around the axis of the cabin.

What is claimed is:

1. Transport device for persons, comprising at least one passenger loading and unloading platform, track means extending along said platform and extending a distance away from said platform, a plurality of passenger cabins movable on said track means into and out of adjacency with said platform, each cabin having a fixed floor and an upright wall extending upwardly from said fixed floor, each cabin having a vertically movable floor that extends laterally outwardly from said fixed floor, means mounting said movable floor for vertical movement relative to said fixed floor, means to raise said vertically movable floor when the cabin is adjacent said platform to bring said movable floor adjacent a level position with the platform, means thereafter to lower said movable floor relative to said fixed floor to permit said movable floor to pass beneath said platform, and a door to close the cabin.

2. A device as claimed in claim 1, in which said door is rotatable about an upright axis between open and closed positions and swings around behind said upright wall through 360° as the cabin moves along said track means from one point on said track means entirely along the track means and back to said one point, said door being closed when the cabin is away from the platform and open when the cabin is adjacent the platform.

3. A device as claimed in claim 1, said track means being closed on itself and said platform having two loading and unloading stations along opposite runs of said track means, said movable floor being raised at each of said loading stations and lowered and passing beneath the platform between said two loading stations.

4. A device as claimed in claim 2, and power means to rotate said door about said upright axis.

5. Apparatus as claimed in claim 1, and inclined rolling tracks on which said vertically movable floor rolls to raise and lower the same relative to said fixed floor.

6. A device as claimed in claim 1, and means releasably to interconnect said vertically movable floors in the region of said platform and to disconnect said vertically movable floors away from said platform so that said cabins travel in spaced apart relationship away from said platform but in interconnected fashion adjacent said platform.

7. A device as claimed in claim 1, and cross members carried by the cabin on which said vertically movable floor rests when the movable floor is lowered and the cabin is remote from the platform.

8. A device as claimed in claim 2, said door being mounted on pivots that are disposed on the axis of rotative movement of the door.

9. A device as claimed in claim 2, and means for rotating said door in only one direction relative to the cabin.

* * * * *